US006065948A

United States Patent [19]

Brown

[11] Patent Number: 6,065,948

[45] Date of Patent: May 23, 2000

[54] DISCHARGE CHECK VALVE IN A SCROLL COMPRESSOR

[75] Inventor: Jerry E. Brown, La Crosse, Wis.

[73] Assignee: American Standard Inc., Piscataway, N.J.

[21] Appl. No.: 09/098,807

[22] Filed: Jun. 17, 1998

[51] Int. Cl.[7] ..... F01C 1/02

[52] U.S. Cl. ..... 418/55.1; 418/270; 137/533; 137/533.17; 137/533.19

[58] Field of Search ..... 418/55.1, 270; 137/533, 533.17, 533.19

[56] References Cited

U.S. PATENT DOCUMENTS

| | | | |
|---|---|---|---|
| 55,531 | 6/1866 | Peabody | 137/533.19 |
| 4,820,130 | 4/1989 | Eber et al. . | |
| 4,840,545 | 6/1989 | Moilanen . | |
| 5,451,148 | 9/1995 | Matsuzaki et al. . | |
| 5,466,136 | 11/1995 | Yamada et al. | 418/55.6 |
| 5,494,422 | 2/1996 | Ukai et al. . | |
| 5,533,875 | 7/1996 | Crum et al. | 418/55.6 |

FOREIGN PATENT DOCUMENTS

| | | | |
|---|---|---|---|
| 550267 | 11/1954 | Belgium | 137/533 |
| 3146030 | 5/1983 | Germany | 137/533 |

*Primary Examiner*—Thomas Denion
*Assistant Examiner*—Thai-Ba Trieu
*Attorney, Agent, or Firm*—William J. Beres; William O'Driscoll; Peter D. Ferguson

[57] ABSTRACT

A scroll compressor has a discharge check valve assembly comprised of a valve and a valve cage. The valve is maintained open within the assembly by the flow of discharge gas from the scroll set during the normal course of compressor operation and is essentially unaffected by momentary gas backflow and/or momentary pressure pulsations that can repetitively occur in the discharge pressure portion of the compressor shell during such operation. At the same time, the valve is quickly responsive to close the discharge port to gas backflow upon compressor shutdown. A dash pot volume, defined between the discharge valve and its cage, is vented to the discharge pressure portion of the compressor shell and is such that the valve is maintained open and does not chatter in the face of momentary gas backflow and/or pressure pulsations yet closes quickly when the compressor shuts down to prevent the backflow of high pressure gas to the scroll set.

21 Claims, 2 Drawing Sheets

FIG. 3
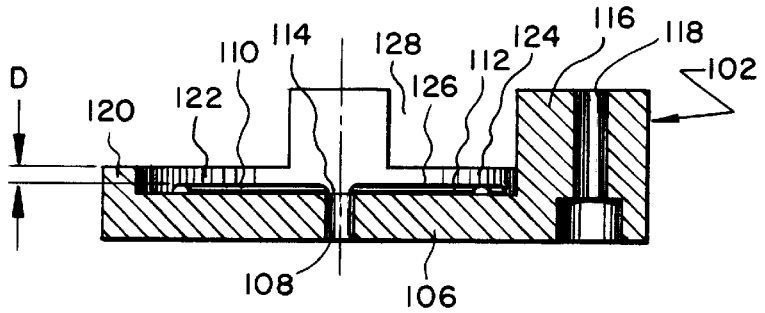
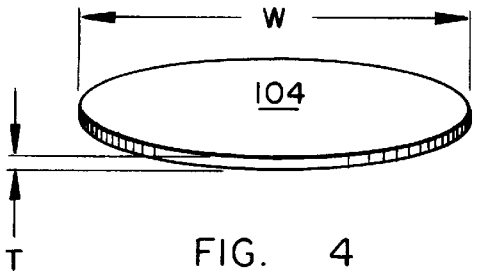
FIG. 4
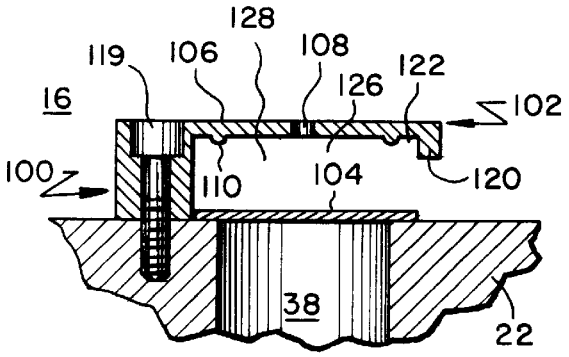
FIG. 5A
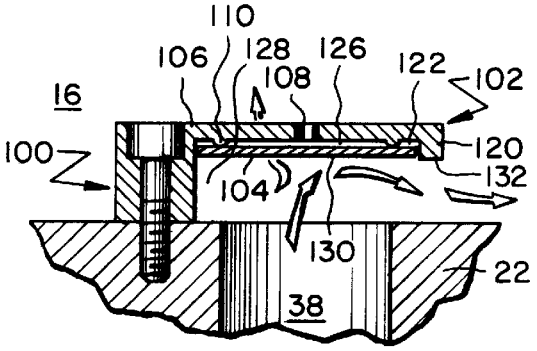
FIG. 5B
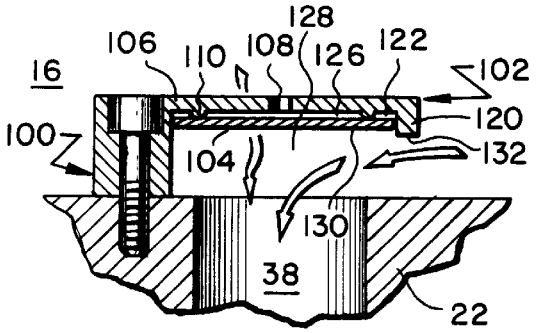
FIG. 5C
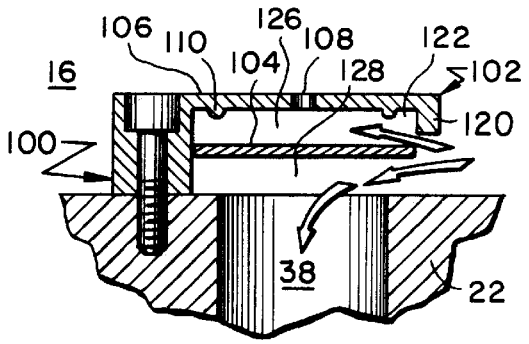
FIG. 5D

DISCHARGE CHECK VALVE IN A SCROLL COMPRESSOR

BACKGROUND OF THE INVENTION

The present invention relates to refrigerant compressors of the scroll type. More particularly, the present invention relates to a discharge check valve arrangement in a scroll compressor in which the valve element is maintained open and is generally unaffected by the momentary gas backflow and/or pressure pulses that can occur during normal compressor operation, yet moves to close the discharge port quickly upon compressor shutdown so as to protect the compressor against high speed and prolonged reverse direction scroll rotation and the damage resulting therefrom.

Scroll compressors are compressors having tw4o interleaved scroll wraps extending from opposing end plates which, when the compressor is in operation, undergo relative orbital motion with respect to each other. When such rotation is in the appropriate direction, suction pockets form at the outer periphery of the interleaved scroll wraps, fill with suction gas, close off and are displaced radially inward, decreasing in size until they join and form a discharge pocket out of which compressed gas is expelled into the discharge pressure portion of the compressor shell.

There is a need to isolate the scroll set from the backflow of compressed gas out of the discharge pressure portion of the compressor shell that would otherwise occur when the compressor is shutdown and is no longer driven by its motor. Absent means to quickly isolate the scroll set from the discharge pressure portion of the compressor shell at compressor shutdown, the backflow of compressed gas there out of will cause the scroll set to be driven in a reverse direction at relatively very high speeds in a free-wheeling fashion for a relatively prolonged period of time. Such high speed reverse rotation can damage or destroy the compressor for lack of bearing lubricant or for lack of bearings designed to accommodate scroll rotation at the speeds that a discharge gas-driven scroll member can attain.

A common problem associated with discharge check valve arrangements is the sticking open or unresponsiveness of the valve element of the valve assembly to closure as a result of the valve element's becoming coated with oil and sticking to its seat. In that regard, discharge gas issuing from a scroll set into the discharge pressure portion of the shell of a scroll compressor will carry a small amount of oil entrained within it. Such oil is picked up by the gas that undergoes compression in the scroll set as a result of the passage of that gas through the suction pressure portion of the compressor shell during the course of its travel to the scroll set. Oil is picked up in such travel because the suction pressure portion of such compressors often acts as a sump for oil used to lubricate moving components of the compressor that are located in its suction pressure portion.

Although relatively very small in amount, much of the oil entrained in the compressed gas issuing from the scroll set through the discharge port is disentrained therefrom by its impact with the compressor's discharge check valve assembly. As such, the discharge check valve assembly will typically be oil-coated when the compressor is in operation. Discharge check valve arrangements must, however, be such that the valve element of the arrangement is not prone to sticking open as a result of the adhesive forces that exist between it and its seat as a result of their being oil-coated.

Protection against discharge gas backflow upon compressor shutdown has most typically been accomplished by the installation of a simple check valve arrangement directly over the compressor's discharge port within the discharge pressure portion of the compressor shell. The valve element of the arrangement is forced open or away from the discharge port by the flow of discharge gas from the scroll set. The valve element is carried or urged shut by gravity, spring action and/or with the assistance of the reverse flow of discharge gas out of the discharge pressure portion of the compressor shell back to the scroll set that occurs upon compressor shutdown. Such valve arrangements, in addition to being susceptible to sticking open, can be prone to chattering as a result of the momentary gas backflow pulses that are repetitively created in the discharge pressure portion of the compressor shell while the compressor is in operation. Such chatter creates noise and causes both the valve element and its seating surface to wear.

U.S. Pat. No. 4,820,130, assigned to the assignee of the present invention, focuses on discharge check valve matters but is representative of a fairly complex arrangement having functions other than the discharge check valve function. It is, however, generally explanatory of the need for a discharge check valve in a scroll compressor.

A more recent patent which describes a check valve arrangement is U.S. Pat. No. 5,451,148. The focus of the '148 patent is the provision of a valve element in a discharge check valve arrangement which is not susceptible to sticking open as a result of the adhesion of the valve to its seal due to the oil film which will coat compressor components in the vicinity of the discharge port. That patent is commended to the reader for its teachings with respect to discharge check valves and their use in scroll compressors in general. The patent focuses, however, on a check valve element which is of a specific and relatively complex geometry.

Also of interest is relatively recent U.S. Pat. No. 5,494,422. That patent is directed, among other things, to the problem of overcoming the sticking of the valve element in a discharge check valve arrangement in a scroll compressor in the open position as a result of its being oil-coated and adhering to the valve stop. In the arrangement of the '422 patent, the edge of the valve element appears to remain fully exposed to the flow of discharge gas when the compressor is in operation. While it may not be susceptible to sticking, it does appear to be susceptible to valve chatter due to its exposure, about its periphery, to the normal and repetitive backflow pulses that are created is the discharge pressure portion of the compressor shell by the normal operation of the compressor.

There is a need for an improved discharge check valve arrangement in a scroll compressor which is insensitive to the normal gas backflow pulses and/or pressure pulsations that can be repetitively created during the normal operation of a scroll compressor, is therefore not susceptible to chattering, is not prone to sticking open due to the adhesive forces of oil which coats the valve apparatus when the compressor is in operation and which is immediately responsive to the de-energization of the compressor to close the discharge port off from gas backflow so as to prevent the possible damage or destruction of the compressor due to the flow of discharge gas out of the discharge pressure portion of the compressor shell to the scroll set and the consequent high speed, reverse direction rotation of a scroll member.

SUMMARY OF THE INVENTION

It is an object of the present invention to provide a discharge check valve arrangement for a scroll compressor which is relatively unsusceptible to valve chatter during normal operation of the compressor.

It is another object of the present invention to provide a discharge check valve arrangement for a scroll compressor in which the valve element is not susceptible to sticking open due to adhesive forces created between the valve element and its seat by the oil film that will exist in the discharge check valve location when the compressor is in operation.

It is another object of the present invention to provide a discharge check valve arrangement in a scroll compressor that is essentially unresponsive to the normal gas backflow pulses and/or pressure pulsations that are repetitively created during operation of a scroll compressor.

It is still another object of the present invention to provide a discharge check valve arrangement in a scroll compressor that is unresponsive to the normal, repetitively created gas backflow pulses that exist in a scroll compressor when the compressor is in operation yet which is immediately responsive for discharge port closure purposes to the de-energization of the compressor even if components thereof are oil coated at the time.

These and other objects of the present invention, which will become apparent when the attached drawing figures and following Description of the Preferred Embodiment are considered, are accomplished by a discharge check valve arrangement in which the valve element is caused to move into a recess in a valve cage by the discharge of gas from the scroll set upon compressor start-up and is maintained securely therein so long as compressor operation continues. The valve element and valve seat are such that the adhesive force of the oil which coats the check valve apparatus is insufficient to cause the valve element to stick in the open position when valve closure is called for. The valve seat cooperates with the back surface of the valve element and the valve cage in the definition of a dash pot volume which is vented to the discharge pressure portion of the compressor's shell so that during compressor operation, the valve element is maintained in the valve cage and is not subject to chatter. Upon compressor shutdown, the valve element is caused to immediately move out of the valve cage and away from the valve stop so as to reliably close the compressor discharge port against backflow in time to prevent the occurrence of damage to the scroll set due to reverse direction scroll rotation.

DESCRIPTION OF THE DRAWINGS

FIG. 3 is a view taken along line 3—3 of FIG. 2.

FIG. 4 is a perspective view of the check valve element of the check valve arrangement of the present invention.

FIGS. 5*a*, 5*b*, 5*c* and 5*d* schematically illustrate discharge gas flow and check valve element position during: in the case of FIG. 5*a*, compressor shutdown; in the case of FIG. 5*b*, the discharge of gas out of the discharge port of the compressor when the compressor is in normal operation; in the case of FIG. 5*c*, the existence of backflow pulses in the discharge gas that are normally and repetitively created during the operation of the compressor; and, in the case of FIG. 5*d*, the backflow of gas and closure of the valve element that occurs upon compressor shutdown.

DESCRIPTION OF THE PREFERRED EMBODIMENT

Figure 1:
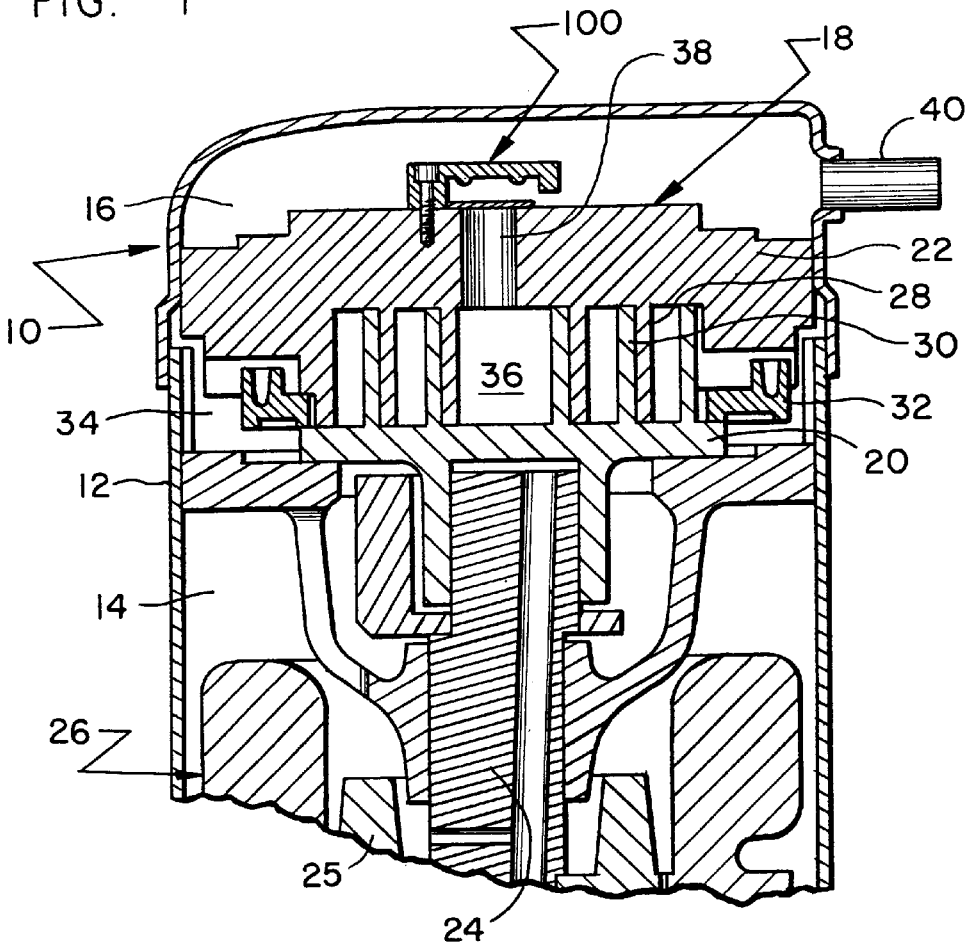
FIG. 1 is a schematic drawing of the cross-section of the upper portion of the scroll compressor of the present invention.
Figure 2:
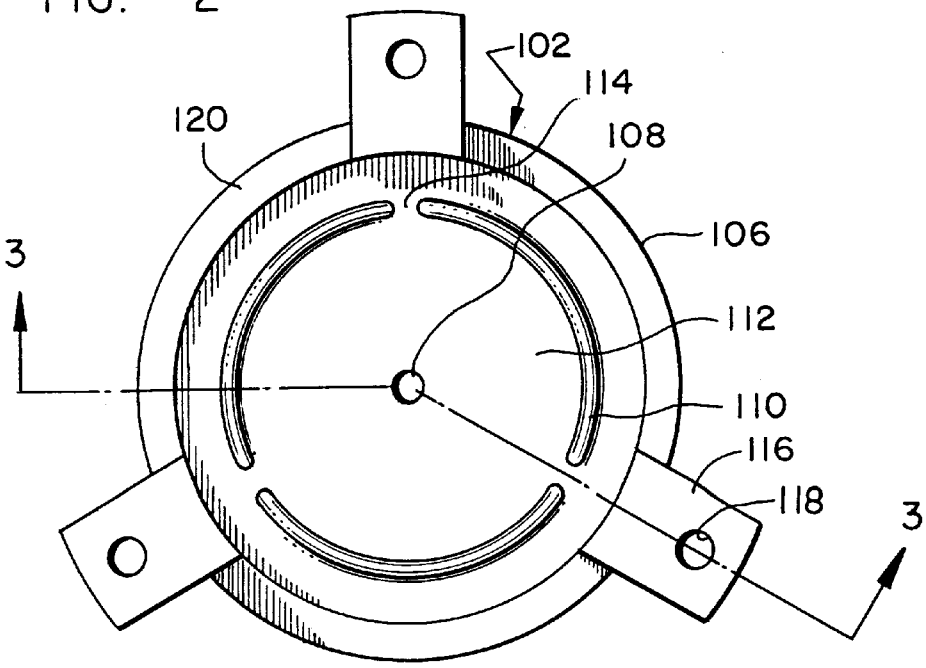
FIG. 2 is a bottom view of the valve cage element of the check valve arrangement of the present invention.

Referring initially to FIG. 1, scroll compressor 10 has a shell 12 that is internally divided into a suction pressure portion 14 and a discharge pressure portion 16. The scroll compressor of the preferred embodiment is of the type which employs a fixed scroll member 18 and an orbiting scroll member 20 although the present invention is applicable to scroll compressors of other than the fixed/orbiting type. In the preferred embodiment, it is the end plate 22 of the fixed scroll member that divides the interior of compressor shell 12 into suction and discharge pressure portions 14 and 16 respectively.

Orbiting scroll member 20 is driven by a drive shaft 24 on which the rotor 25 of compressor drive motor 26 is mounted. Energization of the motor 26 causes rotation of the rotor 25 which, in turn, causes rotation of drive shaft 24. Rotation of shaft 24, in turn, drives the orbiting scroll member.

A predetermined angular relationship is maintained between the wrap element 28 of the fixed scroll member and the wrap element 30 of the orbiting scroll member by an Oldhaa coupling 32 so that in operation, scroll member 20 undergoes relative orbital motion with respect to scroll member 18. It is the relative orbital motion of the wrap elements of the scroll members which causes the creation of two radially opposite compression pockets at the exterior of the interleaved scroll wraps in suction area 34 of compressor 10. Such relative orbital motion causes the compression pockets to repetitively be created, be closed off from suction area 34, be displaced radially inwardly and be decreased in size until they converge to form a single discharge pocket 36 at the center of the scroll set. Pocket 36 is in flow communication with discharge port 38 which opens through scroll end plate 22 into the discharge pressure portion 16 of the compressor shell.

As was heretofore noted, suction gas entering suction pressure portion 14 of the compressor will be exposed to oil in an oil sump (not shown) which is typically located at the bottom of shell 12. As a result, a small amount of oil becomes entrained and is carried in the suction gas to suction area 34 and into the compression pockets formed by the scroll members. Such oil is carried with the gas that undergoes compression in the scroll set and is useful in the lubrication of the surfaces of the scroll members that cooperate in the formation of the compression pockets as well as in the lubrication of the Oldham coupling. Some of such lubricant is, however, carried out of the scroll set in the gas which is discharged through discharge port 38 into discharge pressure portion 16 of the compressor shell. A portion of such oil comes to be disentrained by impact with discharge check valve assembly 100, which is disposed above discharge port 38, and coats the components thereof.

Compressed gas expelled from discharge pocket 36 into and through discharge port 38 enters discharge pressure portion 16 of the compressor shell 12 after passing through and around discharge check valve assembly 100 and its components. Depending upon system conditions downstream of the compressor, momentary gas backflow and/or pressure pulsations are repetitively created in the discharge pressure portion of the compressor each time a new discharge pocket forms and discharges its gas out of discharge port 38. The creation of such pulses is prevalent when the compressor is operating, due to system conditions, above its design pressure ratio. Once past the discharge check valve assembly, the compressed gas exits of compressor 10 through a discharge fitting 40 from where it flows to the condenser refrigeration system in which compressor 10 is employed.

Referring now to Drawing FIGS. 2, 3, 4 and 5 the constituent components of check valve assembly 100 of the present invention will be discussed. Check valve assembly 100 is comprised of a valve cage 102 and a valve element 104. Valve element 104 is free-floating within valve cage 102 and is a simple disc-shaped element capable of being fabricated of sheet metal by a relatively very inexpensive stamping process. Valve element 104 is, therefore, advantageous with respect to the expense and simplicity of its fabrication as compared to other check valve elements of more complicated geometry and structure.

Valve cage 102 has a top portion 106 in which a vent 108 is defined. A segmented valve seat 110 protrudes from undersurface 112 of the valve cage, there being one or more gaps 114 between the segments of the valve seat. In the preferred embodiment, three leg members 116 extend from top portion 106 of the valve cage and each one thereof defines a passage 118 through which a fastener 119 (not shown in FIGS. 2 or 3 but illustrated in FIGS. 1 and 5) is accommodated for securely mounting the valve cage 102 to fixed scroll member end plate 22 over discharge port 38.

A skirt portion 120 extends from undersurface 112 of the valve cage about its outer periphery between each of legs 116. Skirt 120 extends a distance from surface 112 of the valve cage which is greater than the distance to which valve seat segments 110 extend from that surface.

A recess 122 is formed by valve cage 102 into which valve element 104 is displaced when the compressor is in operation. As will further be described, recess 122 is comprised of a first portion 124 and a second, dash pot volume 126. Dash pot volume 126 is defined radially within valve seat 110 and extends from surface 112 of the valve cage a distance defined by the height of the valve seat 110. Gaps 114 in the valve seat permit pressure between dash pot volume 126 and portion 124 of recess 122 to equalize when valve element 104 is seated against seat 110.

As is illustrated, recess 122 is of a depth "D" which is equal to or slightly greater than the thickness "T" of valve element 104. As is also illustrated, the width "W" of valve element 104 is such that when it is displaced into recess 122 a relatively very small clearance is maintained about its periphery between it and the inner periphery of valve skirt 120. As such, when displaced into recess 122, the outer periphery of valve element 104, as will more thoroughly be described, is shielded from the gas backflow pulses that are repetitively and momentarily created in the discharge pressure portion of the compressor when the compressor is in operation and check valve assembly 100 presents an essentially uniform, smooth and flat undersurface to gas flowing through it, whether such flow is out of or into caged area 128 of the check valve assembly.

When compressor 10 is in operation, dash pot volume 126 is a relatively closed volume defined between undersurface 112 of valve cage 102 and the upper surface of valve element 104 and is vented to discharge pressure portion 16 of the compressor shell through vent 108. Vent 108 is purposefully sized to permit volume 126 to act as a dash pot, which reduces the force with which valve element 104 seats against valve seat 110 as it is displaced thereonto, yet to ensure that when valve element 104 is seated against valve seat 110, it is unaffected by the momentary gas backflow or pressure pulses that are created in the discharge pressure portion of the compressor while the compressor is in operation. Put another way, vent 108 is large enough to cushion the seating of valve element 104 against valve seat 110 when the valve element is initially displaced into contact with the valve seat by the flow of discharge gas out of discharge port 38 yet small enough to prevent the upper surface of valve element 104, when seated, from seeing the effects of pressure pulses in the gas within the discharge pressure portion of the compressor that often occur while the compressor is in operation. Valve chatter is thereby prevented.

The valve element is, however, immediately responsive to the discontinuance of discharge gas flow out of discharge port 38 and falls away from valve seat 110 by force of gravity as soon as the force of discharge gas keeping it in place is discontinued when the compressor shuts down. The valve element will fall away from the valve seat, even if coated with oil, due to the small surface contact area between the valve element and the valve seat. Because valve seat 110 is relatively very well shielded from the deposition of oil thereonto by valve element 104 when the valve element is seated thereagainst, it can be expected that a reduced amount of oil will be found within dash pot volume 126. It is to be understood, however, that such shielding is not critical to the immediate operation/response of the valve element when called upon to fall away from the valve seat when needed.

It is to be noted that additional or still more assured responsiveness of valve element 104 to closing could be achieved by the disposition of a spring or other means by which to bias the valve element toward discharge port 38 between the valve cage and valve element. In the preferred embodiment of the invention, however, no such additional bias is needed or employed.

Referring specifically now to FIGS. 5*a*, 5*b*, 5*c* and 5*d*, operation of the check valve assembly of the present invention and its unique features will be described. First, and with reference to FIG. 5*a*, when compressor 10 is not operating, valve element 104 rests over discharge port 38 and is maintained there by force of gravity, having moved into that position when the compressor last shut down. When the compressor is de-energized, there are no forces, other than gravity, acting on valve element 104.

Referring now to FIG. 5*b*, when the compressor next starts up, the force associated with the discharge of compressed gas out of discharge port 38 carries free-floating valve element 104 upward into recess 122 where it seats against valve seat 110. The outer periphery of the valve element is surrounded by and is in close proximity to the inner periphery of skirt 120 of the valve cage. As a result of the relatively very small clearance between the periphery of valve element 104 and skirt 120, the seating of valve element 104 against valve seat 110 creates an essentially closed dash pot volume 126 which defined between valve element 104, top portion 106 of valve cage 102 and valve seat 110. Dash pot volume 126 is, however, vented to discharge pressure portion 16 of the compressor through vent 108.

During the discharge of gas from discharge port 38, valve element 104 is maintained firmly against valve seat 110 by the flow of gas out of discharge port 38. In its seated position, illustrated in FIG. 5*b*, the outer periphery of valve element 104 is protected from and is essentially unexposed to the flow of gas through the discharge pressure portion of the compressor shell. Further, an essentially flat, smooth and unbroken undersurface, cooperatively defined by the face 130 of valve element 104 and the downward facing surface 132 of skirt 120, is presented to gas flowing out of or into caged area 128 of the check valve assembly. Because of the relatively small clearance between the outer periphery of the valve element and skirt 120, relatively little oil will make its way into recess 122 and onto the upper surface of valve element 104 or onto valve seat 110. Once again, however, valve element 104, even if oil coated, will be immediately responsive to closure when called for due to its weight, the force of gravity and the relatively small area of contact between valve element 104 and valve seat 110 that exists when the valve element is displaced into contact with the valve seat.

Referring now to FIG. 5*c*, the momentary and repetitive production of reverse direction pressure pulses and/or gas backflow while the compressor is in normal operation is illustrated. Such pulses and/or backflows are of short duration are created in the discharge pressure portion of the compressor shell as a result of the scroll compression process and system conditions downstream of the compressor. Such pulses and/or backflows are only momentary but are repetitively created and do move briefly through the gas in the discharge pressure portion 16 of the compressor shell, in a direction which is back toward the discharge port, when the compressor is in operation.

The result of such gas backflow and/or pressure pulses, unless otherwise accounted for, can be to cause the valve element of the discharge check valve apparatus to be momentarily displaced from its seat. Such displacement is, once again, only momentary and the valve element is reseated as soon as the next created discharge pocket formed by the scroll set begins discharging its gas into the discharge pressure portion of the compressor shell through discharge port 38. The repetitive, momentary displacement of the valve element from its seat as a result of gas backflow and/or pressure pulses can cause so-called valve chatter which not only creates unwanted noise but can cause significant wear of the valve element and valve seat. That, in turn, can lead to malfunction or destruction of the discharge check valve apparatus and, eventually, the compressor.

In the present invention, the fact that valve element is shielded and ensconced within recess 122, the fact that the periphery of the valve element is juxtaposed immediately adjacent the inner periphery of valve skirt 120 with little clearance therebetween, the fact that valve element 104 and valve skirt 120 present an essentially smooth and unbroken undersurface to gas flowing both into and out of caged area 128 and the fact that dash pot volume 126 is vented through a vent passage that is sized so as not to permit valve element 104 to be affected by such pulses or momentary gas backflow all act to keep valve element 104 in place, without chattering, while the compressor is in operation. As a result, the discharge check valve apparatus of the present invention is not prone to chatter or the wear that can result therefrom.

Referring now to FIG. 5*d*, when compressor 10 shuts down, a rush of discharge gas out of the discharge pressure portion of the compressor back into the scroll set occurs. That rush of gas very quickly exceeds the length and duration of the momentary backflow pulses that repetitively occur when the compressor is in operation. Such backflow of gas at compressor shutdown occurs due to the fact that the orbiting scroll member is no longer driven by the compressor's motor which, in turn, makes the orbiting scroll member an element which is capable of being driven in a reverse, free-wheeling, high speed fashion by the flow of high pressure discharge gas back through discharge port 38 and into the scroll set.

As has been noted, the high speed reverse direction rotation of the scroll set, if permitted to occur, can damage or destroy a compressor for the reason that the discharge gas is capable of driving the orbital scroll member in a reverse direction at a speed which is far higher than both the speed at which the scroll member is driven by the compressor's motor during normal compressor operation and the speed which the bearings in which the drive shaft of orbital scroll member rotate are designed to accommodate. Further, in most scroll compressors, bearing lubrication is predicated on the disposition of a pump at the lower end of the compressor drive shaft. In some compressor designs, that pump might operate to deliver oil only when the drive shaft is driven in the direction it is meant to be driven when the compressor is in the normal operation. The prolonged rotation of the orbital scroll member and crankshaft in the wrong direction in such compressors, can, therefore, quickly deplete any residual oil that might be located at or in their bearings causing the bearings to run dry under the reverse direction rotation circumstance. That can lead to the damage or destruction of the compressor for lack of lubrication at the bearing surfaces.

In the present invention, discontinuance of the discharge of gas out of discharge port 38, which occurs on compressor shutdown, causes valve element 104 to immediately drop off of its seat for lack of a force, in the form of discharge gas issuing from discharge port 38, to keep it seated against seating surface 110. As soon as valve element 104 moves off its seat, by force of gravity, it is caught by the initial rush of gas backflowing out of the discharge pressure portion 16 of the compressor shell and is carried downward therewith, immediately covering and closing discharge port 38 and interrupting/preventing the further backflow of discharge gas out of discharge pressure portion 16 into the scroll set virtually as soon as it starts. In this manner, damage to the compressor due to reverse rotation is prevented by an arrangement which is not subject to valve chatter yet which is reliable, quick-acting, robust and relatively inexpensive of manufacture. Further, the responsiveness of valve assembly 100 to closure results in quicker compressor shutdown and a reduction of the noise associated therewith. Reduction of such noise is significant in the context of application of such compressors in residential air conditioning units where such noise is to be avoided or minimized if at all possible.

While the present invention has been disclosed in the context of a preferred embodiment, modifications and changes thereto which fall within the spirit of the invention will be apparent to those skilled in the art. As such, the scope of the invention is not limited to the invention as described in terms of the preferred embodiment but embraces equivalents thereto.

What is claimed is:

1. A scroll compressor having a discharge pressure portion comprising:

a first scroll member, said first scroll member having an end plate and a scroll wrap, and scroll warp extending from said end plate;

a second scroll member, said second scroll member having an end plate and a scroll wrap, said scroll wrap extending from said end plate, the wraps of said first and said second scroll members being interleaved, the end plate of said second scroll member defining a port through which gas is discharged when said compressor is in operation; and a discharge check valve assembly, said assembly including a valve cage and a valve element, said valve cage having a surface from which a seating surface extends and which overlies said port defined in said second scroll member end plate, said valve element being positionable within said valve cage between a first position in which said valve element overlies and closes said port defined in said second scroll member end plate and a second position in which said valve element is displaced by gas discharged through said port, away from said port and into contact with said seating surface, the periphery of said valve element, when said valve element is in said second position, being shielded from the effect of gas backflow and pressure pulses that occur in the discharge pressure portion of said compressor when said compressor is in operation.

2. The scroll compressor according to claim 1 wherein said valve element and said valve cage cooperate to define a dash pot volume, said dash pot volume being defined between said overlying surface of said valve cage and said valve element, said valve cage defining a vent passage between said dash pot volume and said discharge pressure portion of said compressor shell.

3. The scroll compressor according to claim 2 wherein the periphery of said valve element is closely juxtaposed a cooperating surface of said valve cage when said valve element is in said second position so that said dash pot volume is an essentially closed volume.

4. The scroll compressor according to claim 3 wherein said valve element is displaced into said second position by the flow of discharge gas out of said port defined in said second scroll member end plate and wherein said valve element drops away from said seating surface by the force of gravity when the force of discharge gas issuing from said port defined in said second scroll member end plate is insufficient to maintain said valve element seated against said surface, the dropping of said valve element away from said seating surface being essentially unaffected by any adhesive forces between said valve element and said seating surface.

5. The scroll compressor according to claim 4 wherein said valve cage has a circumferential skirt portion, said skirt portion having a lower surface and said cooperating surface of said valve cage being an inner surface of said skirt portion, and wherein said valve element is a disc-shaped member having an upper surface, a lower surface and a peripheral surface, said upper surface of said valve element contacting said seating surface of said valve cage, said peripheral surface of said valve element being closely juxtaposed said inner surface of said skirt portion of said valve cage and said lower surface of said valve element being essentially co-planar with said lower surface of said skirt portion of said valve cage when said valve element is in said second position.

6. The scroll compressor according to claim 5 wherein said vent passage is sized so as to prevent the displacement of said valve element off of said valve seat by the conduct of momentary gas backflow or pressure pulses therethrough.

7. The scroll compressor according to claim 6 wherein said seating surface has at least one gap defined therein whereby the dash pot volume defined outside of said seating surface is in flow communication with the dash pot volume defined within said seating surface, said gap facilitating pressure equalization within said dash pot volume.

8. The scroll compressor according to claim 1 wherein said valve element and said valve cage cooperate to define a dash pot volume, said dash pot volume being defined between said overlying surface of said valve cage and said valve element, said dash pot volume being vented into said discharge pressure portion of said compressor shell through a vent passage, said vent passage being sized to prevent the entry of backflowing gas and pressure pulses into said dash pot volume when said valve element is in said second position, said valve element falling away from said seating surface by the force of gravity alone when the flow of discharge gas out of said discharge port ceases to be sufficient to maintain said valve element in said second position against the force of gravity.

9. The scroll compressor according to claim 8 wherein said valve cage and said valve element have surfaces that are generally co-planar when said valve element is in said second position, said surfaces being exposed to the flow of gas out of said port when said compressor is in operation.

10. The scroll compressor according to claim 1 wherein said valve cage has a top portion, said overlying surface being a surface of said top portion, said seating surface extending from said overlying surface, said top portion having a skirt portion extending therefrom in the same direction and to an extent greater than said seating surface extends from said overlying surface of said top portion, said valve cage having a plurality of legs by which said top portion is connected to said second scroll member.

11. The scroll compressor according to claim 10 wherein said valve element is free-floating within said valve cage and cooperates with said top portion and said skirt portion of said valve cage to define a vented dash pot volume.

12. The scroll compressor according to claim 11 wherein said valve element and said skirt portion cooperate to shield said seating surface from the deposition of oil thereonto.

13. A scroll compressor having a discharge pressure portion comprising:

a first scroll member, said first scroll member having an end plate from which a scroll wrap extends;

a second scroll member, said second scroll member having an end plate from which a scroll wrap) extends, the wraps of said first and said second scroll members being interleaved, the end plate of said second scroll member defining a discharge port through which gas flows into said discharge pressure portion of said compressor when said compressor is in operation;

a valve cage attached to said second scroll member, said valve cage having a surface which is spaced from and overlies said discharge port defined in said second scroll member end plate, said overlying surface having a seating surface extending therefrom; and a valve element, said valve element having a peripheral surface, said valve element being positionable in said valve cage between a first position in which said valve element overlies and closes said port defined in said second scroll member end plate and a second position in which said valve element is displaced away from said port and into contact with said seating surface of said valve cage, said seating surface of said valve cage and said peripheral surface of said valve element being shielded, when said valve element is in said second position, from gas flowing out of said discharge port and any oil entrained therein as well as from gas backflow or pressure pulses in said discharge pressure portion of said compressor that momentarily occur when said compressor is in operation.

14. The scroll compressor according to claim 13 wherein said valve element and said valve cage cooperate to define a dash pot volume, said dash pot volume being vented through said valve cage to said discharge pressure portion of said compressor.

15. The scroll compressor according to claim 14 wherein said valve element has a surface which is exposed to the discharge of gas through said discharge port when said compressor is in operation and wherein said valve cage has a skirt portion, said skirt portion having a lower surface, said surface of said valve element that is exposed to the flow of discharge gas when said compressor is in operation being generally co-planar with the lower surface of said skirt portion when said valve element is in said second position.

16. The scroll compressor according to claim 15 wherein said peripheral surface of said valve element cooperates with a surface of said valve cage to shield said seating surface from the deposition of oil thereonto when said compressor is in operation.

17. The scroll compressor according to claim 16 wherein said valve element is disc-shaped and is free-floating within said valve cage, said peripheral surface of said valve element being closely juxtaposed an inner circumferential surface of said valve cage when said valve element is in said second position.

18. The scroll compressor according to claim 17 wherein said skirt portion of said valve cage extends from said valve cage a distance which is essentially equal to the distance that said seating surface extends from said valve cage plus the thickness of said disc-shaped valve element.

19. The scroll compressor according to claim 18 wherein said seating surface has at least one gap defined therein, said at least one gap being a path by which pressure within said dash pot volume equalizes when said valve element is seated on said seating surface.

20. The scroll compressor according to claim 14 wherein said shielding of said seating surface of said valve cage and of said peripheral surface of said valve element substantially prevents the entry of oil carried in said gas which flows into said discharge pressure portion of said compressor through said discharge port from entering said dash pot volume whereby said valve element is essentially unaffected by any adhesive forces that would otherwise be created by the deposition of oil onto said seating surface, said valve element falling away from said seating surface by the force of gravity and essentially without adhesion to said seating surface when the force of gas flowing into said discharge pressure portion of said compressor ceases to be sufficient to maintain said valve element seated against said seating surface.

21. The scroll compressor according to claim 14 wherein the dash pot vent is sized so as to prevent the unseating of said valve element from said seating surface by the affect of momentary gas backflow or pressure pulses in said discharge pressure portion of said compressor.

* * * * *